United States Patent [19]

Alissandratos

[11] 4,033,650

[45] July 5, 1977

[54] SANITARY BRUSH ASSEMBLY

[76] Inventor: Tacko D. Alissandratos, P.O. Box 606, Tarpon Springs, Fla. 33589

[22] Filed: Feb. 5, 1976

[21] Appl. No.: 655,568

Related U.S. Application Data

[63] Continuation-in-part of Ser. No. 363,580, May 24, 1973, abandoned.

[52] U.S. Cl. ..... 312/206; 312/242; 312/326; 312/329

[51] Int. Cl.[2] ..... A46B 17/00

[58] Field of Search ..... 15/144 B, 159 R; 211/65, 66; 312/138 R, 138 A, 206, 242, 270, 305, 326, 329

[56] References Cited

UNITED STATES PATENTS

| | | | |
|---|---|---|---|
| 123,295 | 1/1872 | Sanford et al. | 312/305 |
| 735,700 | 8/1903 | Bonney | 211/65 X |
| 2,039,065 | 4/1936 | De Mark | 312/206 |
| 2,697,646 | 12/1954 | Craig | 312/342 X |
| 2,987,782 | 6/1961 | Kurowski | 312/138 R X |
| 3,171,135 | 3/1965 | Polichio | 312/329 X |

FOREIGN PATENTS OR APPLICATIONS

| | | | |
|---|---|---|---|
| 686,252 | 1/1953 | United Kingdom | 15/144 B |

*Primary Examiner*—James C. Mitchell
*Attorney, Agent, or Firm*—Edwin E. Greigg

[57] ABSTRACT

A toilet bowl brush and wall mounted enclosure device therefore, comprising a sanitary brush having a telescopically extensible handle and a rigid head at one end with its bristle face inclined with respect to the axis of said handle. A semi-spherical flange surrounds the portion of the handle adjoining said head adapted to eccentrically suspend said brush from a bracket on the door of said device with respect to the pivotal mountings of the door thereof so as to normally maintain said door in closed position over said sanitary brush in the wall in which the device is mounted.

5 Claims, 17 Drawing Figures

SANITARY BRUSH ASSEMBLY

This application is a continuation-in-part of application Ser. No. 363,580, filed May 24, 1973 now abandoned.

BACKGROUND OF THE INVENTION

Heretofore devices of this general type, while necessary, have been usually equipped with a brush having a long handle and as small a container as possible because of its use and appearance. As the device has been necessarily portable it is usually placed on the floor of the bathroom adjacent its source of most frequent use which has proven unsuitable, unsafe and unsightly. Hence the necessity for the instant invention.

OBJECT AND SUMMARY OF THE INVENTION

As is pointed out above, the instant invention is directed to an improved construction and arrangement of parts that have proved both convenient and economical for more frequent use of the device by the average housewife to maintain her bathroom in a more desirable and sanitary condition. The construction of the device as a whole is such that it is more practical, safe and convenient to locate and maintain in a bathroom for the purpose stated. The frequently useable brush is normally unnoticeable in its convenient, yet hidden wall closure, when not in use.

DESCRIPTION OF THE PREFERRED EMBODIMENT

Figure 2:
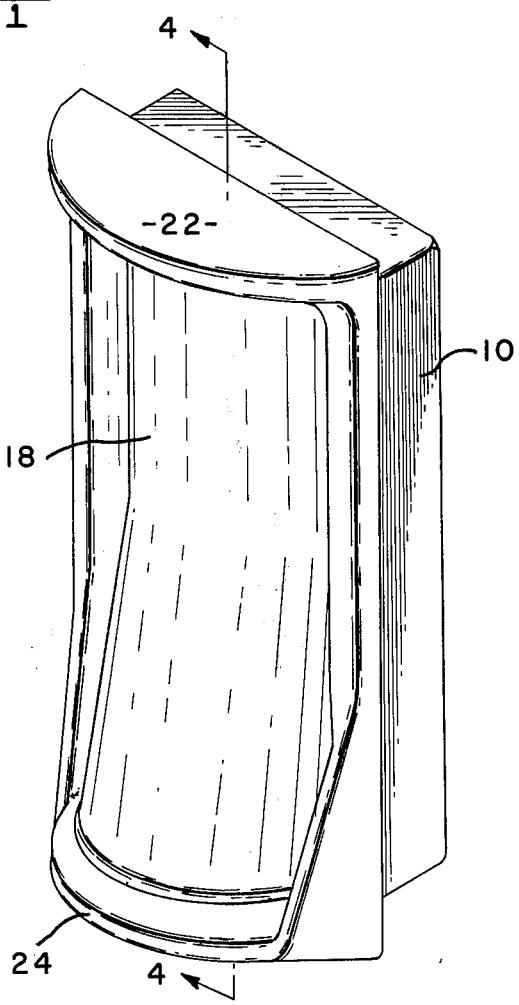
FIG. 2 is an enlarged view of the assembled device of this invention removed from the wall in which it is also designed for support.

Referring now to FIG. 2, it will be noted that the wall mounted toilet bowl brush housing 10 is shown as preferably constructed of a baked clay-like substance which may be colored and glazed to match the tile of the bathroom wall in which it is to be mounted. It is obvious that this housing may, however, be constructed of other materials such as plastic, sheet or cast metal, etc., to support and enclose the sanitary brush 11.

Figure 1:
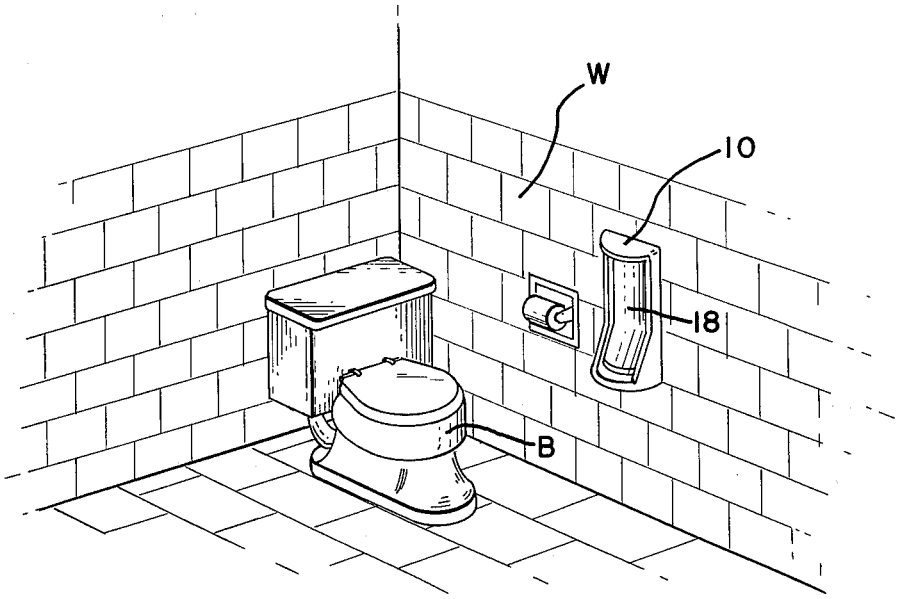
FIG. 1 is a partial view of a tiled wall of a bathroom adjacent the usual toilet bowl showing the instant invention as it would appear in its position for use.
Figure 4:
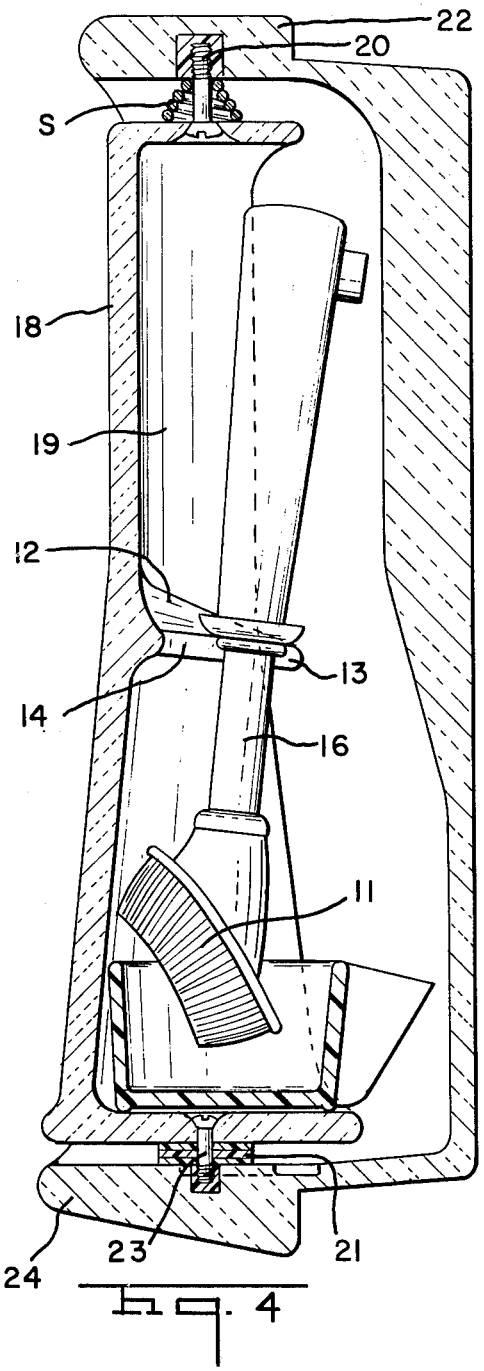
FIG. 4 is a further enlarged transverse vertical sectional view taken on the line 4—4 of FIG. 2, the parts being shown only partly in section but in the position in FIG. 2.
Figure 5:
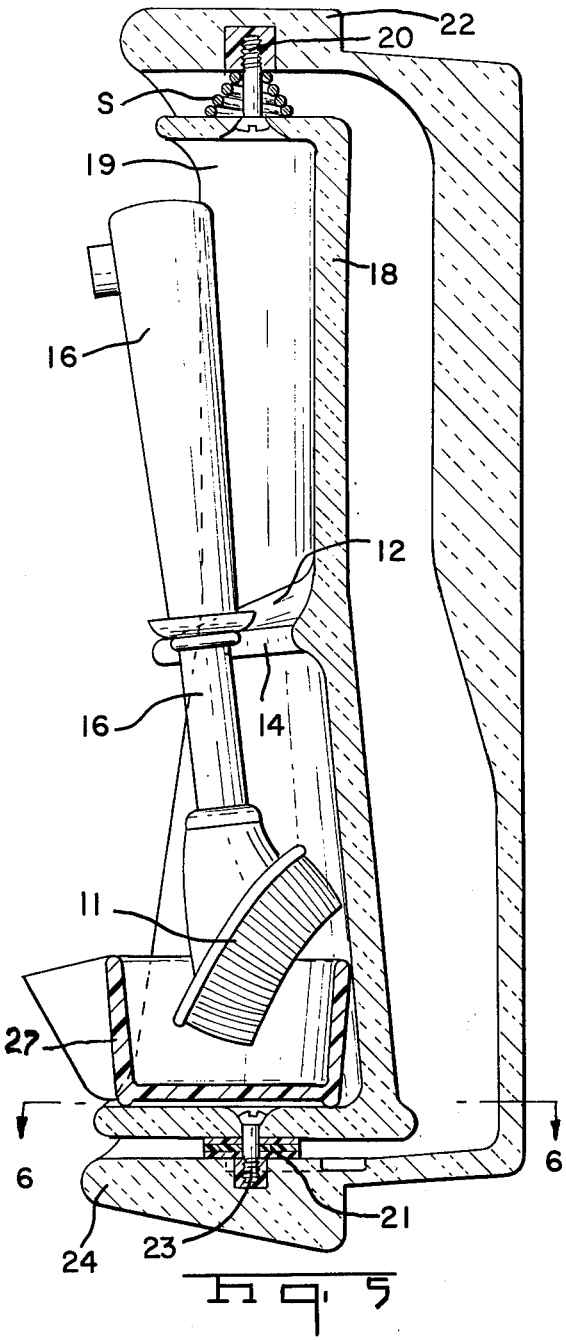
FIG. 5 is an enlarged view similar to FIG. 4 showing the door supporting drip cup and brush swung about on it vertically, aligned pivotal mountings to expose the brush supporting recess side thereof as in FIG. 3.
Figure 6:
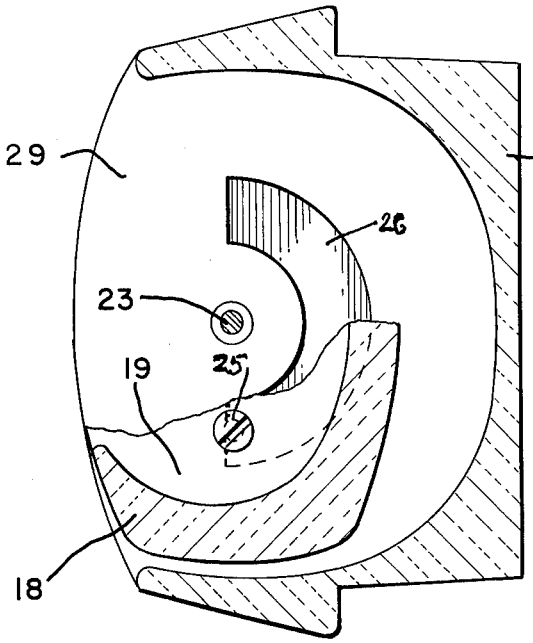
FIG. 6 is a transverse sectional view taken on line 6—6 of FIG. 5 with the fragmental power part of the door in open position.
Figure 7:
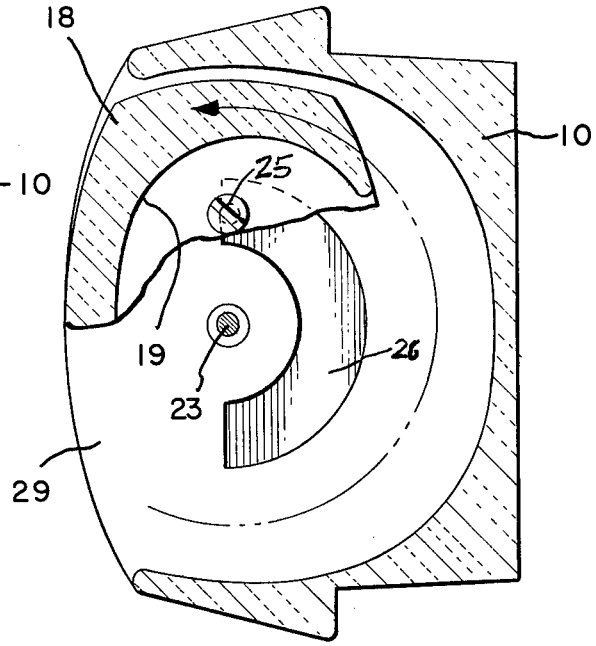
FIG. 7 is a view similar to FIG. 6 with the fragmental lower part of the door in closed position.

The bracket-like shelf 12 is integral with and includes a front entrance slot 13 and is depressed around its inner side edges as at 14 to provide a suitable seat 14 for retaining the semispherical flange 15 surrounding the lower tubular handle section 16 of the sanitary brush. While examining FIG. 1, it will be noted that the recessed body of the housing 10 is normally closed across the front thereof by a pivotally mounted door 18, the body of which is centrally recessed as at 19 in opposition to the recessed body of the housing 10 when in the normal closed position of FIGS. 2 and 4 thereacross to support the sanitary brush 11 and to enclose the same within the recessed body of the housing 10. The upper and lower pivotal mountings 20 and 21, respectively, for the door 18 are best shown in FIG. 4. The upper pivotal mounting 20 depends from the top closure wall 22 about centrally of the recessed housing and the lower pivotal mounting 23 of the door 18 is mounted in the bottom closure wall 24. The sanitary brush 11 will be supported by its handle 16 from the bracket shelf 12 forward of the pivotal point 23 for the recessed door when said door is swung to the fully open position of FIG. 5. In this position of parts the door is stopped by a screw 25 butting the end of the semicircular groove or channel 26, see FIGS. 6 and 7. The brush 11 will thus be supported in a good advanced position for its removal from the bracket shelf 12 spanning the recess 19 in the side of the door 18. A drip saucer 27 is shown mounted on the short bottom floor of the pivotal door 18 so as to prevent any dripping from the brush, after use, contaminating the lower or bottom pivotal point 23.

Figure 10:
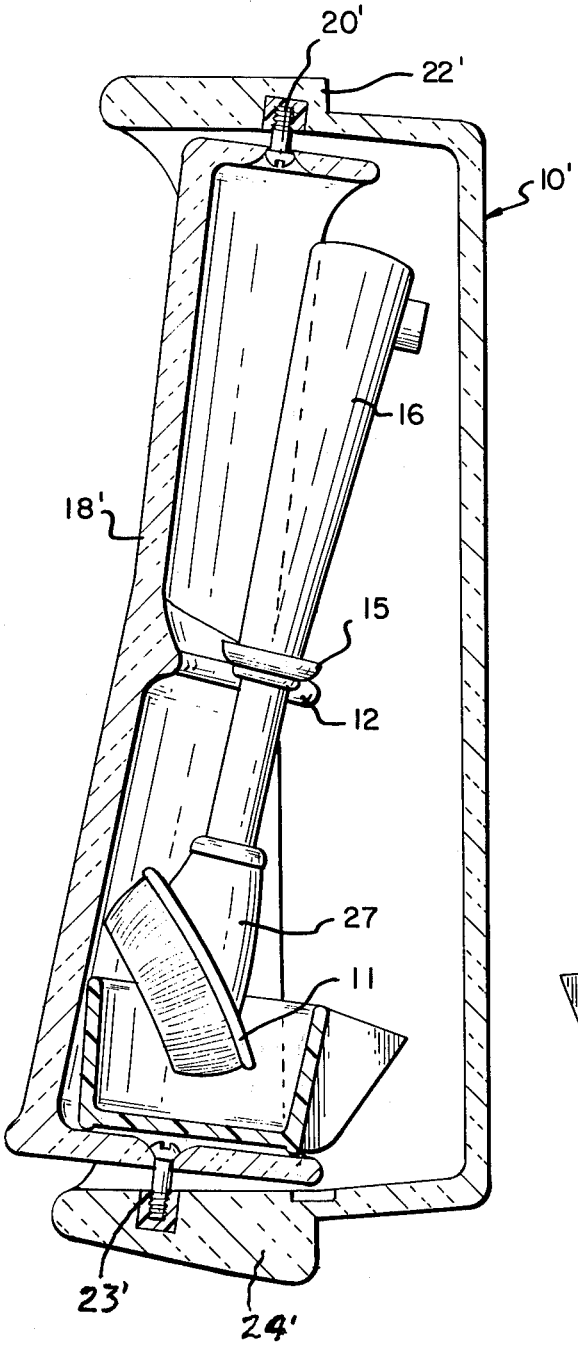
FIG. 10 is a view similar to FIG. 4, showing a modified form of the brush housing with the pivotal mountings for the door set on an angle to the vertical.
Figure 11:
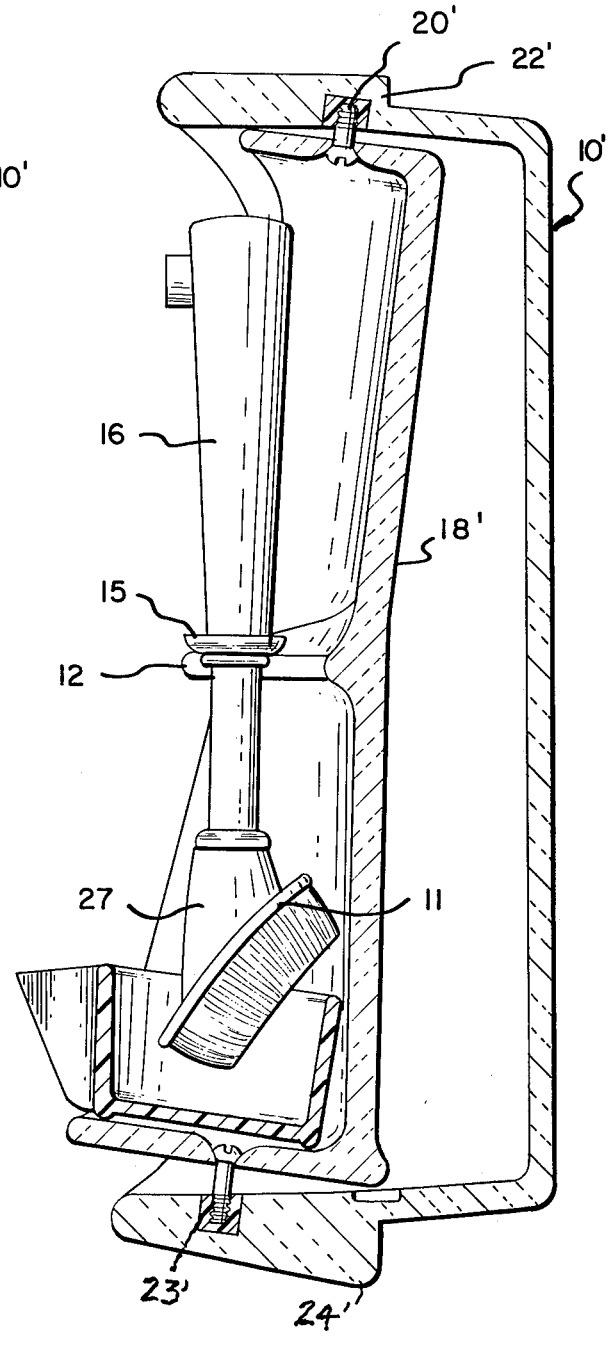
FIG. 11 is another view of the modified device of FIG. 10 with the door swung around to open position.

Due to the eccentric weight of the brush when wet, it would normally only be necessary to start the recessed door 18 toward closed position to insure its complete closing, but to insure this closure a metal coiled spring element S may be placed between the top closure face of the door and the housing extension 22 or the pivot points 20 and 21 may be disposed at an angle to the vertical as shown in the modified showings of FIGS. 10 and 11.

Figure 3:
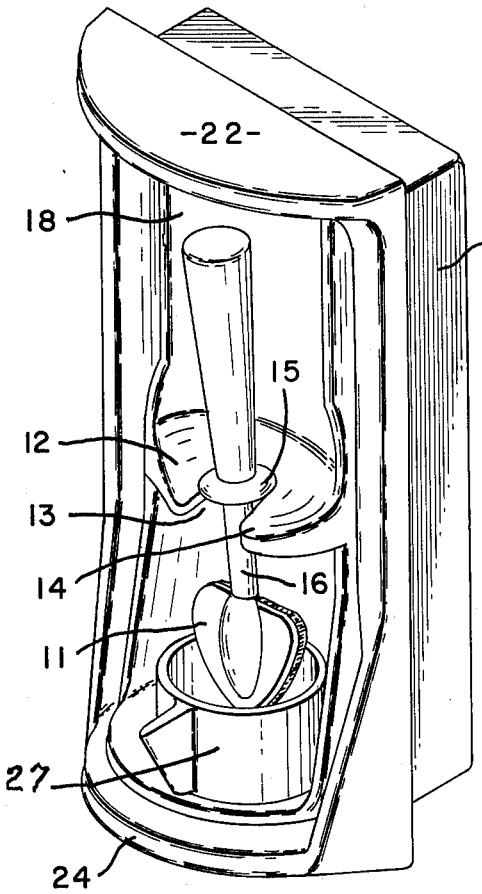
FIG. 3 is a view similar to FIG. 2 showing the normally closed door manually swung around to open position showing the door supported sanitary brush and drip cup carried thereby.
Figure 8:
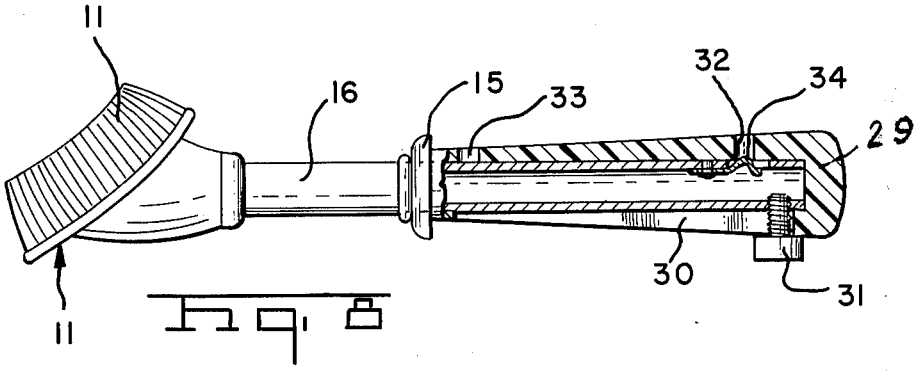
FIG. 8 is a side view of the sanitary brush removed from the housing and with its extensible handle portion and hand grip retracted for support on the bracket of the door within the enclosure.
Figure 9:
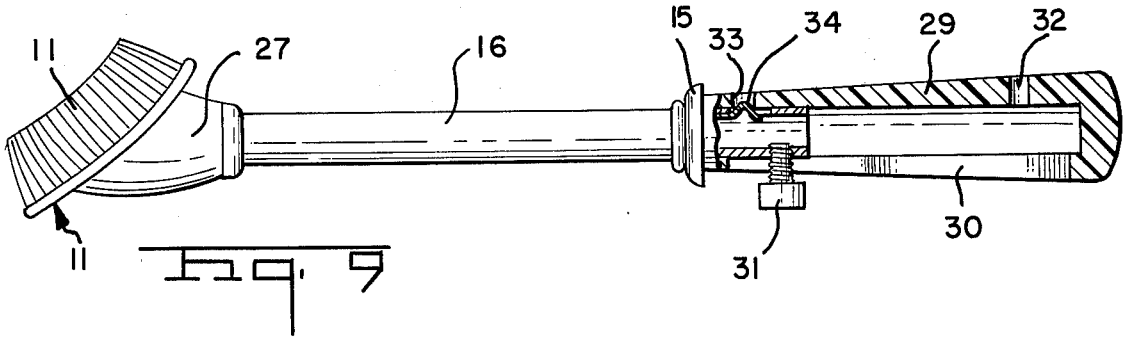
FIG. 9 is also a side view of the brush as in FIG. 8 but having the hand grip on the lower handle portion fully extended and adapted to be secured for use.

In FIG. 8 is shown the sanitary brush element 11 removed from its supporting bracket 12 on the recessed side of the door 18. This figure also shows more clearly the enlarged hand grip portion 29 which is also tubular and has a slot 30 in one side thereof for the body of the set screw 31, carried by the lower outer end of the tubular handle portion 16 to ride when telescopically extending the handle from the retracted position shown in FIGS. 3 and 8 to the position of use shown in FIG. 9. Here it should be stated that the normal extent of telescopic adjustment of the handle grip is fixed by the longitudinally spaced, aligned holes 32 and 33 on the side opposite the slot 30 and in which the spring catch 34 seats to retain the handle in a retracted or extended position.

Referring now to the embodiment of the invention shown in FIGS. 12–17, there is disclosed a positive and simplified means for returning the door 18 to a closed position, which is generally shown in FIG. 2.

Figure 12:
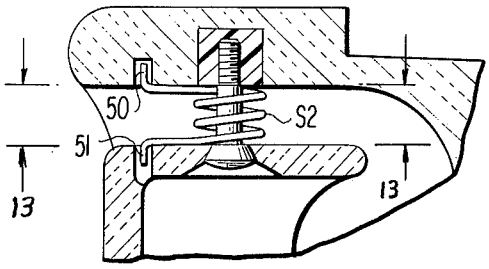
FIG. 12 is an enlarged fragmentary view of a further embodiment of this invention showing a portion of the door and its mounting arrangement.
Figure 14:
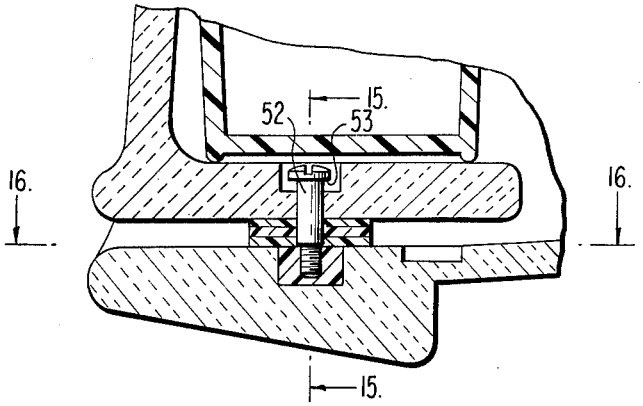
FIG. 14 is an enlarged fragmentary view of the further embodiment of the door and its mounting arrangement shown in FIG. 12.
Figure 15:
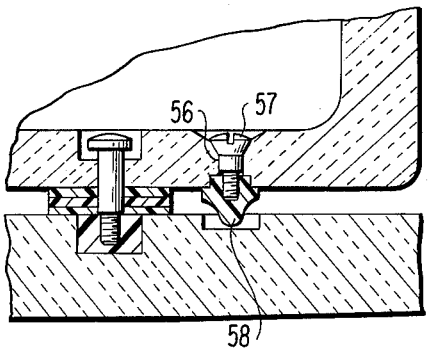
FIG. 15 is a view on line 15—15 of FIG. 14 showing the pivotal support for the door.

By referring to the views in FIGS. 12 and 14 and considering them to be fragmentary exploded views of the structure shown in FIG. 4, for example, one notes that the spring S2 is provided with oppositely extending tangs 50 and 51, the purpose of which will become apparent later. The bottom pivot 52 for the door 18 is also modified so as to include a shoulder 53 to thereby permit the door to rise up and down on the shank of the pivot 52 as it is revolved from its opened position to its closed position.

Figure 13:
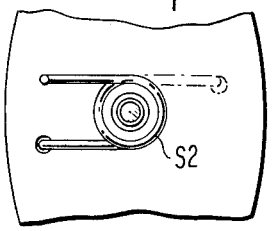
FIG. 13 is a view on line 13—13 of FIG. 12 showing the door closing mechanism.

Turning now to the view in FIG. 13, it will be observed that the spring S2 is shown in plan with both legs in full lines. At that time the door is closed as well shown in FIG. 2. Also in FIG. 13 there is illustrated in dotted lines the condition of one of the legs of the spring when the door 18 is opened.

Figure 16:
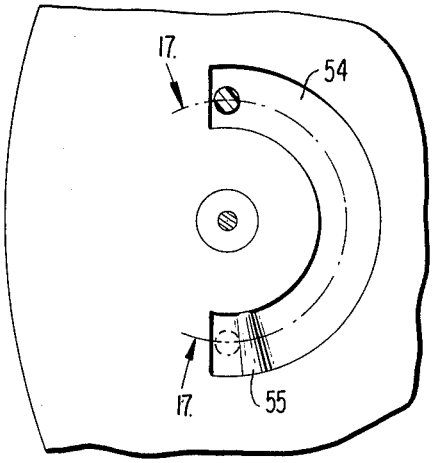
FIG. 16 is a fragmentary top plan view looking down into a portion of the brush housing.
Figure 17:
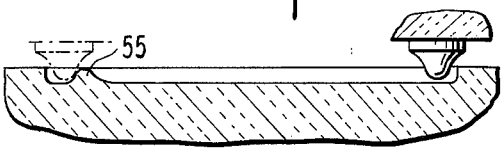
FIG. 17 is a view on the arcuate line 17—17 of FIG. 16 showing the path of travel of the door stop mechanism.

By now turning to the views in FIGS. 16 and 17, one will observe that the arcuate channel 54 is provided adjacent to one extremity thereof with an upstanding protrusion 55, the opposite side walls of which merge smoothly into the channel 54. The bottom wall of the door 18 is appropriately apertured as at 56 and arranged to receive a threaded stud 57 to which is secured a suitable slide member 58 which may be constructed of any convenient inexpensive plastic material, since its only function is to contact the protrusion 55 and retain the door 18 in the open position which is clearly shown in FIGS. 16 and 17.

In view of the foregoing it will be understood that when the housewife or other user of the sanitary brush assembly rotates the door 18 from its closed position (FIG. 2) into its open position (FIG. 3) as the door is turned about its pivot 52 and against the influence of spring S2, the slide member 58 moves through the arcuate channel 54 and as the slide approaches the slope leading to the protrusion, the door slides up the shank of member 52, over the protrusion and then comes to rest in the position shown in FIG. 16. When the use of the brush has served its purpose and been returned to the support 12, a slight tap on the door causes the spring S2 to close the door once again due to the stored torsional energy in the spring.

What is claimed is:

1. A wall-mounted enclosure device for a sanitary brush useable in cleaning toilet bowls and the like, which comprises:

a recessed receptacle having top and bottom walls closing the ends of the receptacle;

a recessed door arranged for limited vertical movement and rotatably supported by and connected to the ends of the receptacle by an upper and a lower pivotal mounting therebetween, said door being pivotable between an open position wherein the door recess faces in the same direction as the receptacle recess, and a closed position wherein the door recess is opposed to the receptacle recess;

a single shelf rigid with said door and extending across the recess therein substantially medially thereof, said shelf defining a slot extending inwardly thereof from an outer edge of the shelf, in which the brush handle may be seated to suspend the brush from the shelf into a lower portion of the door recess;

closing spring means;

means cooperative with said receptacle for retaining the door in its open position against a closing force exerted on the door by the closing spring means, which include an arcuate channel defined by the bottom wall of the receptacle, facing a bottom surface of the door, and concentric with the lower pivotal mounting of the door, said bottom wall also defining a raised protrusion in the channel adjacent one end of the channel, a slide member attached to the bottom surface of the door, arranged to slide in the arcuate channel as the door is rotated about its pivotal mountings, so that the slide member is disposed at one end of the channel when the door is open, and at the other end of the channel when the door is closed, the door being displaced upward as the slide member traverses the raised protrusion in the channel, and the raised protrusion acting on the slide member to hold the door in its open position against the force of the closing spring means until the door is manually rotated toward its closed position and the slide member again traverses the raised protrusion, whereupon the closing spring means returns the door to its closed position.

2. The device of claim 1, wherein a drip catcher is carried by said door, and said brush extends into said drip catcher.

3. The device of claim 1, wherein said door includes means cooperative with said receptacle for retaining the door in an open position.

4. The device of claim 1, wherein said brush includes a telescopically extensible handle.

5. The device as claimed in claim 1, wherein said brush has a scrubbing face inclined with respect to the handle therefor.

* * * * *